US012359519B2

(12) United States Patent
Feng et al.

(10) Patent No.: US 12,359,519 B2
(45) Date of Patent: Jul. 15, 2025

(54) CORING AND SAMPLING INTEGRATED SUB AND DOWNHOLE INSTRUMENT

(71) Applicant: CHINA OILFIELD SERVICES LIMITED, Tianjin (CN)

(72) Inventors: Yongren Feng, Hebei (CN); Tao Lu, Hebei (CN); Lin Huang, Hebei (CN); Shusheng Guo, Hebei (CN); Xiaodong Chu, Hebei (CN); Kun Xu, Hebei (CN); Tiemin Liu, Hebei (CN); Yongchao Chen, Hebei (CN); Yongzeng Xue, Hebei (CN); Xinhuo Weng, Hebei (CN); Guoqiang Zhang, Hebei (CN); Suogui Shang, Hebei (CN); Yang Shen, Hebei (CN); Ya Jin, Hebei (CN)

(73) Assignee: CHINA OILFIELD SERVICES LIMITED, Tianjin (CN)

( * ) Notice: Subject to any disclaimer, the term of this patent is extended or adjusted under 35 U.S.C. 154(b) by 0 days.

(21) Appl. No.: 18/266,518

(22) PCT Filed: Oct. 29, 2021

(86) PCT No.: PCT/CN2021/127511
§ 371 (c)(1),
(2) Date: Jun. 9, 2023

(87) PCT Pub. No.: WO2022/267288
PCT Pub. Date: Dec. 29, 2022

(65) Prior Publication Data

US 2024/0026747 A1 Jan. 25, 2024

(30) Foreign Application Priority Data

Jun. 25, 2021 (CN) ..... 202110710639.9

(51) Int. Cl.
*E21B 25/10* (2006.01)
*E21B 49/06* (2006.01)
*E21B 49/10* (2006.01)

(52) U.S. Cl.
CPC ..... *E21B 25/10* (2013.01); *E21B 49/06* (2013.01); *E21B 49/10* (2013.01)

(58) Field of Classification Search
CPC ..... E21B 25/10; E21B 25/14; E21B 49/10
See application file for complete search history.

(56) References Cited

U.S. PATENT DOCUMENTS 11,905,829 B2 * 2/2024 Lu ..... G01V 11/002
2005/0284629 A1 * 12/2005 Reid ..... E21B 49/04 166/264

(Continued)

FOREIGN PATENT DOCUMENTS

CN 101353962 A 1/2009
CN 101424170 A 5/2009

(Continued)

OTHER PUBLICATIONS

First Office Action for Chinese Application No. 202110710639.9, dated Jul. 8, 2022, 15 Pages (including English Translation).

(Continued)

*Primary Examiner* — Blake Michener
(74) *Attorney, Agent, or Firm* — BROOKS KUSHMAN P.C.

(57) ABSTRACT

A coring and sampling integrated sub, including an integrally formed base body, a probe module, a coring module and a hydraulic module. The probe module, the coring module and the hydraulic module are all mounted on the base body. The hydraulic module, the probe module and the coring module are sequentially arranged from top to bottom. An output end of the hydraulic module is configured to be (Continued)

connected to the probe module and the coring module, respectively. The hydraulic module is configured to provide telescopic power for the probe module, and provide power for movement, flipping, and pushing of the coring module. Also disclosed is a downhole instrument including the coring and sampling integrated sub.

19 Claims, 13 Drawing Sheets

(56) References Cited

U.S. PATENT DOCUMENTS

| | | | | |
|---|---|---|---|---|
| 2006/0000606 | A1* | 1/2006 | Fields | E21B 49/10 166/264 |
| 2008/0066534 | A1* | 3/2008 | Reid | E21B 49/081 73/152.09 |
| 2009/0025941 | A1 | 1/2009 | Iskander et al. | |
| 2009/0114447 | A1* | 5/2009 | Reid, Jr. | E21B 25/00 175/58 |
| 2014/0090893 | A1* | 4/2014 | Reid | E21B 25/08 175/59 |
| 2017/0107813 | A1* | 4/2017 | Feng | E21B 4/16 |
| 2017/0214291 | A1* | 7/2017 | Feng | E21B 49/06 |
| 2018/0371904 | A1* | 12/2018 | Van Zuilekom | E21B 49/06 |
| 2019/0145252 | A1* | 5/2019 | Naveena-Chandran | E21B 49/06 166/250.17 |
| 2020/0291735 | A1* | 9/2020 | Feng | E21B 49/06 |
| 2021/0285849 | A1* | 9/2021 | Tian | G01N 1/08 |
| 2021/0389294 | A1* | 12/2021 | Krueger | G01N 33/241 |
| 2022/0316290 | A1 | 10/2022 | Lu et al. | |
| 2022/0397491 | A1* | 12/2022 | Tian | G01N 1/08 |

FOREIGN PATENT DOCUMENTS

| | | | |
|---|---|---|---|
| CN | 201599026 | U | 10/2010 |
| CN | 202596725 | U | 12/2012 |
| CN | 106640064 | A | 5/2017 |
| CN | 108756874 | A | 11/2018 |
| CN | 111157701 | A | 5/2020 |
| CN | 113494257 | A | 10/2021 |
| GB | 2318372 | A | 4/1998 |
| WO | 2018213523 | A1 | 11/2018 |

OTHER PUBLICATIONS

International Search Report for Application No. PCT/CN2021/127511, dated Mar. 23, 2022, 4 Pages (including English Translation).

Second Office Action for Chinese Application No. 202110710639.9, dated Feb. 17, 2023, 17 Pages (including English Translation).

* cited by examiner

CORING AND SAMPLING INTEGRATED SUB AND DOWNHOLE INSTRUMENT

CROSS-REFERENCE TO RELATED APPLICATIONS

This application is the U.S. national phase of PCT Application No. PCT/CN2021/127511 filed on Oct. 29, 2021, which claims priority of Chinese Patent Application No. 202110710639.9 filed on Jun. 25, 2021, which are hereby incorporated herein by reference in their entireties.

TECHNICAL FIELD

The present disclosure relates to but is not limited to the field of logging, in particular to a coring and sampling integrated sub and a downhole instrument.

BACKGROUND

At present, in the field of logging, both borehole wall coring and formation testing aim at obtaining formation objects, which are very important logging means and belong to two different logging sequences. Two series of instruments are required to complete two series of logging operations, and the instruments are required to be lifted and lowered many times, which makes an operation service process occupy a wellhead of the platform for a long time, increases a risk of sticking downhole instruments and has high operation intensity.

SUMMARY

The following is a summary of subject matter described in detail herein. This summary is not intended to limit the protection scope of the claims.

At least one embodiment of the present disclosure provides a coring and sampling integrated sub, including an integrally formed base body, a probe module, a coring module and a hydraulic module, wherein the probe module, the coring module and the hydraulic module are all mounted on the base body; the hydraulic module, the probe module and the coring module are arranged in sequence from top to bottom; an output end of the hydraulic module is configured to be respectively connected with the probe module and the coring module, and the hydraulic module is configured to provide telescopic power for the probe module, and to provide a power for movement, turn-over and core-pushing of the coring module.

At least one embodiment of the present disclosure provides a downhole instrument including the coring and sampling integrated sub described above.

Other aspects will become apparent upon reading and understanding the drawings and detailed description.

Figure 1:
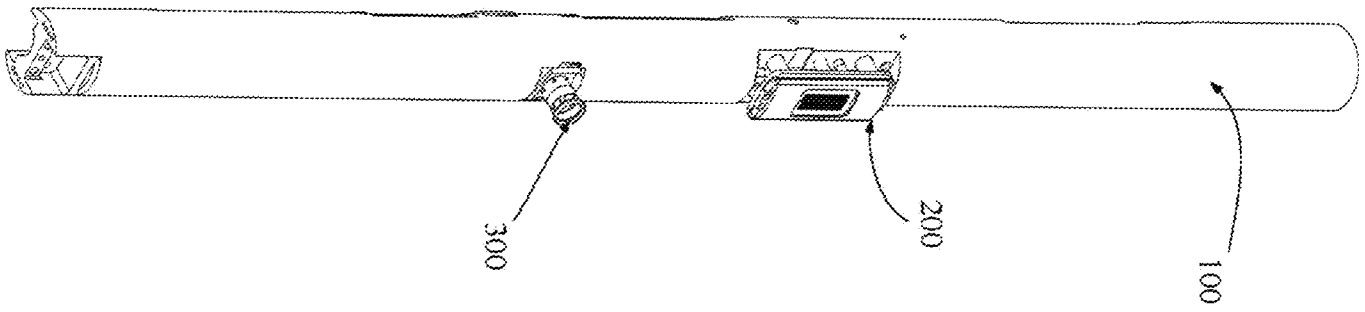
FIG. 1 is a schematic diagram of a coring and sampling integrated sub according to an embodiment of the present disclosure.

Reference numerals: 100—base body, 101—upper joint, 102—mounting groove, 103—lower joint, 104—second mounting chamber, 105—first mounting chamber, 106—mounting notch, 107—hydraulic control segment, 108—probe segment, 109—coring segment, 110—first hydraulic chamber, 111—second hydraulic chamber, 112—base body suction segment, 113—first channel, 114—second channel, 115—special-shaped end cap, 116—connection channel, 117—branch channel, 118—sampling channel, 119—first release push arm, 120—upper push arm, 121—second release push arm, 122—secondary push arm, 200—probe module, 201—probe, 202—outward-extension hydraulic cylinder, 203—suction channel, 204—retraction hydraulic cylinder, 205—first piston, 206—second piston, 300—coring module, 301—drill bit, 302—motor assembly, 303—cable, 304—drilling rod, 305—core-pushing rod, 306—spacer mechanism, 307—core storage barrel, 308—fixing plate, 309—sliding plate, 310—second transverse beam, 311—core-breaking reset assembly, 312—first transverse beam, 313—guide rail slot, 314—slider, 315—convex post, 316—mounting shaft, 317—cable joint, 400—hydraulic module, 500—coring and sampling integrated sub, 600—telescopic sub, 700—support sub, 800—rotation sub.

DETAILED DESCRIPTION

Hereinafter, embodiments of the present disclosure will be described in detail with reference to accompanying drawings. It is to be noted that the embodiments in the present application and features in the embodiments may be combined with each other randomly if there is no conflict.

Referring to a coring and sampling integrated sub according to the embodiments of the present invention in FIG. 1-FIG. 15, functional modules of coring and sampling are integrated in the coring and sampling integrated sub. As shown in FIG. 1 to FIG. 6, the sub includes an integrally formed base body 100, and a probe module 200, a coring module 300 and a hydraulic module 400 mounted on the base body 100. The hydraulic module 400, the probe module 200 and the coring module 300 are arranged in sequence from top to bottom. An output end of the hydraulic module 400 is configured to be connected with the probe module 200 and the coring module 300 respectively. The hydraulic module 400 is configured to provide a telescopic power for the probe module 200 and to provide a power for movement, turn-over and core-pushing of the coring module 300. The coring and sampling integrated sub is configured to integrate the coring module 300 and the probe module 200 for sampling on one sub. The coring and sampling integrated sub can cover thicknesses of most of reservoirs, also greatly shorten a length of downhole instruments, reduce costs and improve safety.

Figure 7:
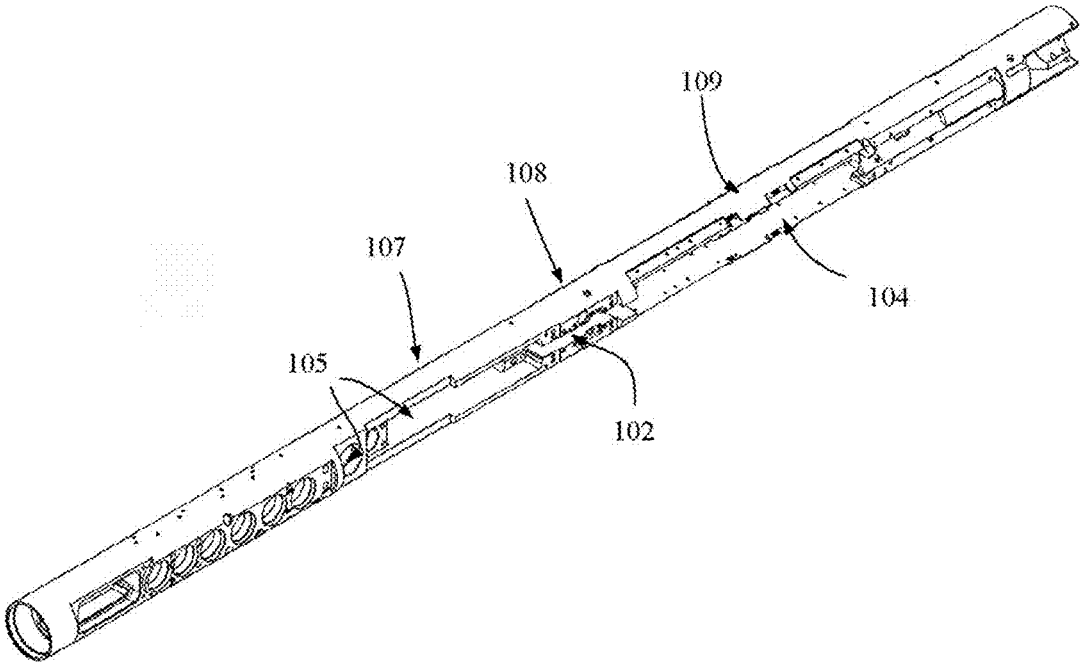
FIG. 7 is a schematic diagram of a base body in FIG. 1.
Figure 8:
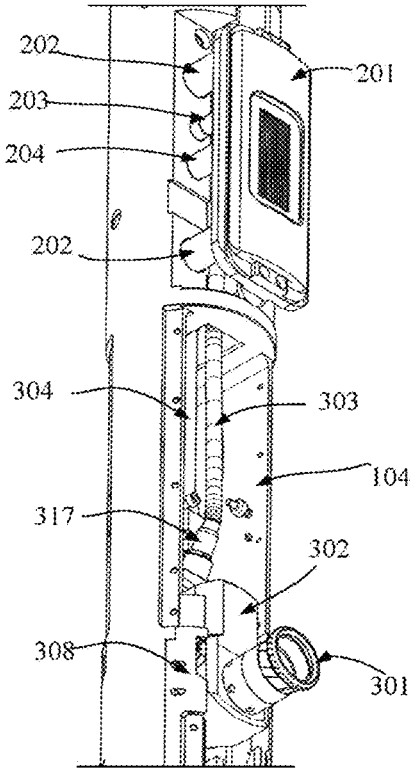
FIG. 8 is a first partial schematic diagram of the coring and sampling integrated sub of FIG. 1.

A downhole instrument is usually formed by connecting multiple subs, which are basic units of downhole instruments. The integrally forming of the above-mentioned base body 100 means that the base body 100 is processed and formed by a metal blank, that is, it cannot be further split in a length direction. As shown in FIG. 1 and FIG. 7, the base body 100 includes a hydraulic control segment 107, a probe segment 108 and a coring segment 109 which are sequentially connected. The hydraulic control segment 107, the probe segment 108 and the coring segment 109 are respectively provided with a first mounting chamber 105, a mounting groove 102 and a second mounting chamber 104, which can provide mounting space for the hydraulic module 400 and the coring module 300 and the like. In addition, the first mounting chamber 105 and the second mounting chamber 104 are each provided with an opening, and the base body 100 is provided with a detachable cover plate corresponding to each of openings to close the opening. An outer surface of the cover plate can match a surface of the base body 100, so that the sub is cylindrical as a whole. For connection with other subs, an upper joint 101 is provided at a top end of the hydraulic control segment 107, and a lower joint 103 is provided at a bottom end of the coring segment 109.

The mounting groove 102 extends along an axial direction of the base body 100, penetrates through the probe segment 108 vertically, and may be communicated with the first mounting chamber 105 and the second mounting chamber 104. As shown in FIG. 8 to FIG. 11, the probe module 200 is mounted on the probe segment 108, the probe module 200 includes a probe 201 and a drive structure mounted on the probe segment 108. An output end of the drive structure is connected with the probe 201, and the base body 100 is provided with a mounting notch 106 corresponding to the probe 201. The mounting notch 106 matches a shape of the probe 201, such that the probe 201 can be embedded into the base body 100 in a retracted state. The drive structure gives way to the mounting groove 102 and an oil passage or a fluid passage disposed at the probe segment 108, and the drive structure includes two hydraulic drive assemblies correspondingly disposed at two sides of the mounting groove 102 respectively. Either of the hydraulic drive assemblies includes two outward-extension hydraulic cylinders 202 and one retraction hydraulic cylinder 204, but is not limited thereto. For example, either of the hydraulic drive assemblies may include more than two outward-extension hydraulic cylinders 202 and multiple retraction hydraulic cylinders 204. The two hydraulic drive assemblies are disposed correspondingly, and the respective outward-extension hydraulic cylinders 202 and retraction hydraulic cylinders 204 are also disposed correspondingly. Two outward-extension hydraulic cylinders 202 of either hydraulic drive assembly are arranged along the length direction of the probe 201, respectively located at two ends of the base body 100 in the axial direction, and one refraction hydraulic cylinder 204 is intermediately disposed on the probe 201. The outward-extension hydraulic cylinders 202 and the retraction hydraulic cylinder 204 are respectively communicated with the hydraulic module 400 through an oil passage so as to control actions of the outward-extension hydraulic cylinders 202 and the retraction hydraulic cylinder 204 through the hydraulic module 400. The outward-extension hydraulic cylinders 202 can push the probe 201 outward to press against a borehole wall, while the refraction hydraulic cylinder 204 can pull the extended probe 201 back to the base body 100.

Figure 10:
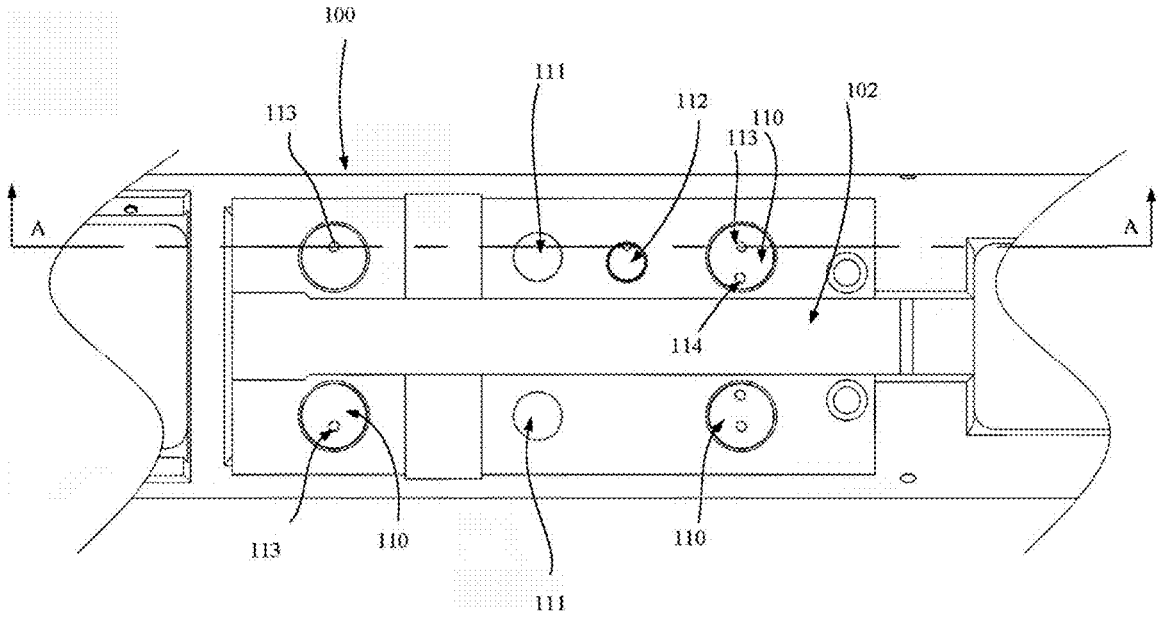
FIG. 10 is a partial schematic diagram of the base body in FIG. 7.
Figure 11:
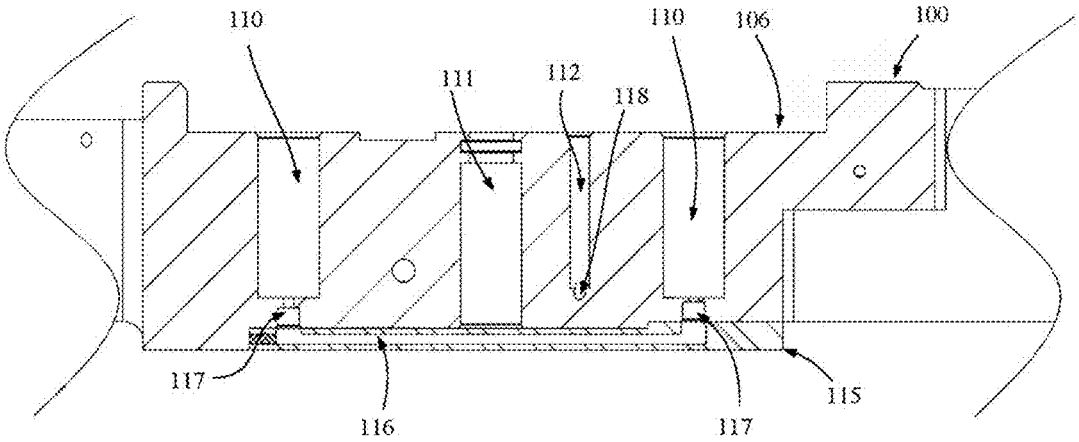
FIG. 11 is a schematic cross-sectional view taken along A-A in FIG. 10.
Figure 12:
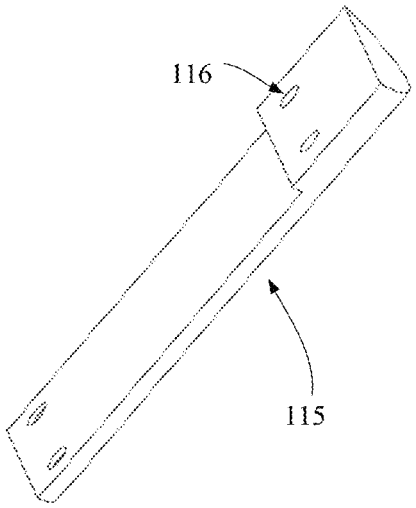
FIG. 12 is a schematic diagram of a special-shaped end cap of FIG. 11.

Different from the related probe structure, as shown in FIG. 10 to FIG. 12, the outward-extension hydraulic cylinders 202 are single-action hydraulic cylinders, and the outward-extension hydraulic cylinders 202 can only act to extend the probe 201 outward. Compared with related double-action hydraulic cylinder used, the outward-extension hydraulic cylinders 202 can extend longer under a same size specification, have a wider range of adaptability, and have more advantages for integration. Each outward-extension hydraulic cylinder 202 includes a first hydraulic chamber 110 disposed on the base body 100, and a first piston 205. One end of the first piston 205 extends into the first hydraulic chamber 110, the other end of the first piston 205 is threaded with the probe 201, and the first hydraulic chambers 110 close to the hydraulic module 400 are both communicated to the hydraulic module 400 through a second channel 114. The second channel 114 is a branch of the oil passage for supplying oil to the two first hydraulic chambers 110 close to the hydraulic module 400, and oil outlets of the second channel 114 is located on chamber walls of the first hydraulic chambers 110 away from the probe 201. Two first hydraulic chambers 110 in one hydraulic drive assembly are communicated through a first channel 113, so that two outward-extension hydraulic cylinders 202 of one hydraulic drive assembly can act synchronously to ensure consistency of actions, so that a total of four outward-extension hydraulic cylinders 202 can act on the probe 201 simultaneously and be extended synchronously, thus avoiding the deviation of the probe 201 and inability to be closely fitted to the borehole wall caused by an asynchronous action. In addition, the base body 100 is further provided with a detachable special-shaped end cap 115, and the special-shaped end cap 115 is mounted at a side of the base body 100 facing away from the probe 201 and corresponds to the probe 201. The first channel 113 includes a connection channel 116 provided on the special-shaped end cap 115 and branch channels 117 located on the base body and communicating the connection channel 116 with the first hydraulic chambers 110. The two branch channels 117 are correspondingly disposed at two ends of the connection channel 116 respectively.

Figure 9:
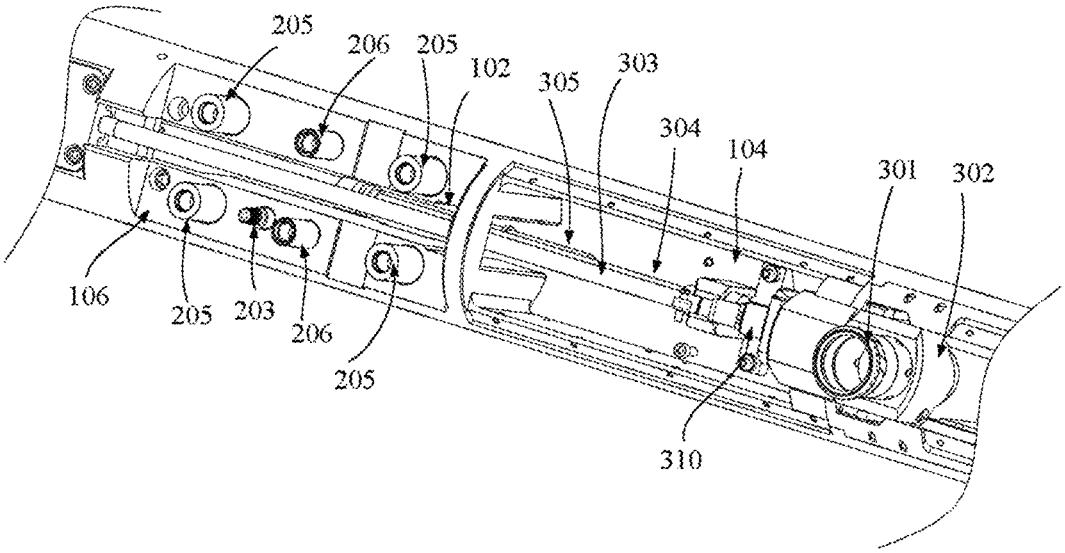
FIG. 9 is a second partial schematic diagram of the coring and sampling integrated sub of FIG. 1.

As also shown in FIG. 9 to FIG. 10, the retraction hydraulic cylinder 204 is also a single-action hydraulic cylinder. The retraction cylinder 204 only acts to retract the probe 201, and the retraction hydraulic cylinder 204 includes a second hydraulic chamber 111 disposed on the base body 100, and a second piston 206. One end of the second piston 206 extends into the second hydraulic chamber 111 and the other end of the second piston 206 is threaded with the probe 201. The second hydraulic chamber 111 is communicated to the hydraulic module 400 through a third channel (not shown in figures), and the third channel is also a branch of the oil passage for supplying oil to the second hydraulic chamber 111. An oil outlet of the third channel is located on a chamber wall of the second hydraulic chamber 111 close to the probe 201. The probe 201 is communicated with a sampling channel 118 in the base body 100 through a telescopic suction channel 203, and the sampling channel 118 extends upwards in the base body 100 and penetrates through the hydraulic control segment 107, and can be communicated with sample analysis modules in other subs at the upper side of the sub. In order to ensure sealing, sealing rings can be disposed at joints between the pistons, the oil passages and the channels to ensure no leakage of fluid.

Multiple integrated hydraulic control valves may be used in the aforementioned hydraulic module 400 to hydraulically control multiple components including the outward-extension hydraulic cylinders 202 and the retraction hydraulic cylinders 204 described above. When sampling is needed, the hydraulic module 400 can control actions of the four outward-extension hydraulic cylinders 202 (i.e., supply hydraulic oil to the outward-extension hydraulic cylinders 202), and the first pistons 205 extend out and uniformly act on the probe 201 to push it toward the borehole wall until it is moved in place, and at the same time, the hydraulic oil in the retraction hydraulic cylinders 204 is also discharged. When the probe 201 needs to be retracted, the hydraulic module 400 can control actions of the two retraction hydraulic cylinders 204 (i.e., supply hydraulic oil to the retraction hydraulic cylinders 204), the second pistons 206 are retracted into the second hydraulic chambers 111, and the probe 201 is pulled away from the borehole wall until it retracts into the base body 100, and the hydraulic oil in the outward-extension hydraulic cylinders 202 is also discharged during this process. As shown in FIG. 2-FIG. 9, a core-pushing drilling assembly is provided at an output end of the hydraulic module 400, the core-pushing drilling assembly penetrates through the probe segment 108 and is connected to the coring module 300, and the hydraulic module 400 is provided with a cable 303 extended downward. The cable 303 is connected to the coring module 300 and the cable 303 also penetrates through the probe segment 108.

As shown in FIG. 3, FIG. 5, FIG. 8, and FIG. 9, the coring-pushing drilling assembly and the cable 303 are mounted within the mounting groove 102 and penetrate through the mounting groove 102, thereby giving way to the probe structure and realizing the integration of coring structure and probe structure. The coring module 300 includes a coring device, a core storage barrel 307 and a spacer mechanism 306. The core storage barrel 307 is disposed at a lower side of the coring device, the spacer mechanism 306 is located at a side of the core storage barrel 307 to provide spacers for cores entering the core storage barrel 307 to separate adjacent cores.

Figure 13:
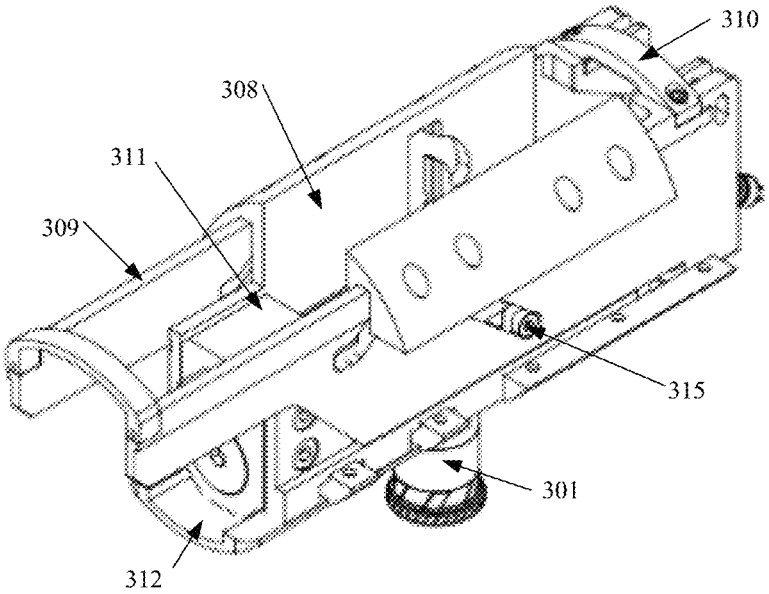
FIG. 13 is a schematic diagram of a coring module in FIG. 1 in a drilling state.
Figure 14:
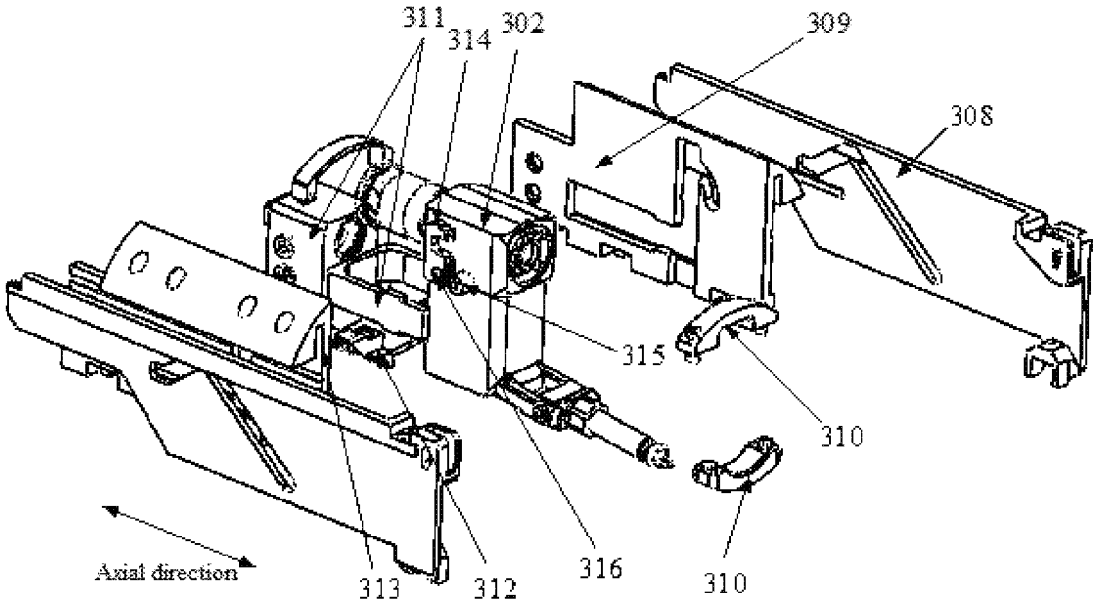
FIG. 14 is a schematic exploded diagram of the coring module in FIG. 1.
Figure 15:
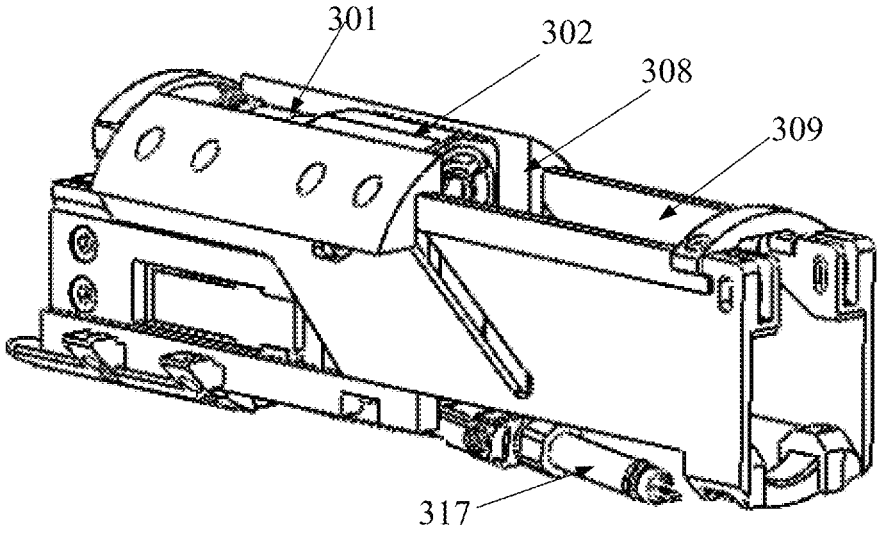
FIG. 15 is a schematic diagram of the coring module in FIG. 1 in a core-pushing state.

As shown in FIG. 13 to FIG. 15, the coring device is a related rotary borehole wall coring device, which includes a drill bit 301, a motor assembly 302, fixing plates 308, sliding plates 309, a core-breaking reset assembly 311 and other components for realizing movement and turnover of the coring device. The drill bit 301 is mounted at an output end of the motor assembly 302 and is driven by the motor assembly 302. The motor assembly 302 is provided with a cable joint 317 which is connected with a cable 303 to ensure power supply of the motor assembly 302. Although the core-pushing drilling assembly can only move along the axial direction, the motor assembly 302 can be pushed to perform actions of turnover, moving and core-breaking, which requires cooperation between the fixing plates 308, the sliding plates 309, the core-breaking reset assembly 311 and other components. Two fixing plates 308 are respectively fixed in the base body 100, the motor assembly 302 is sandwiched between the two fixing plates 308, and two sliding plates 309 are respectively disposed at the outside of the two fixing plates 308 and slidable along the axial direction. The two fixing plates 308 are connected through a first transverse beam 312, and the two sliding plates 309 are connected through a second transverse beam 310. Each fixing plate 308 is provided with a first guide hole, the L-shaped first guide hole is provided with a turn-over segment, a movement segment and a core-breaking segment. A sliding plate 309 at a side of the fixing plate 308 is provided with a second guide hole in a shape of Chinese word "卜" the second guide hole can be divided into a turn-over driving segment, a movement driving segment and a core-breaking driving segment, and an projection of the first guide hole on the sliding plate 309 intersects with the second guide hole. A side surface of the motor assembly 302 facing the fixing plate 308 is provided with a convex post 315 and a mounting shaft 316, and the convex post 315 extends through the first guide hole and into the second guide hole. The motor assembly 302 further has a slider 314 with an opening slot mounted in the first guide hole and rotationally connected to the mounting shaft 316, and the convex post 315 can slide into and out of the opening slot.

An action of turn-over means that the motor assembly 302 is changed from a state in which an axial direction of the drill bit 301 is parallel to an axis of the base body 100 to a state in which the axial direction of the drill bit 301 is perpendicular to the axis of the base body 100, or that the motor assembly 302 is changed from a state in which the axial direction of the drill bit 301 is perpendicular to the axis of the base body 100 to a state in which the axial direction of the drill bit 301 is parallel to the axis of the base body 100, that is, a process in which the state in FIG. 13 and the state in FIG. 15 are switched between each other. When the axial direction of the drill bit 301 is perpendicular to the axis of the base body 100, the drill bit 301 is directly facing the borehole wall, and in this state, the motor assembly 302 can be moved toward the borehole wall to drill a core. When the axial direction of the drill bit 301 is parallel to the axis of the base body 100, the axis of the drill bit 301 is collinear with an axis of the core-pushing rod 305, and the core-pushing rod 305 is movable through the drill bit 301 to push an obtained core downward to the core storage barrel 306. When an action of turn-over is performed, the slider 314 is located at an end of the movement segment adjacent to the turn-over segment, and the convex post 315 is located in the opening slot, for example, if the sliding plate 309 is moved in an axial direction, the turn-over driving segment drives the convex post 315 to slide out of the opening slot and move from the movement segment into the turn-over segment. If a reverse turn-over is needed, the sliding plate 309 can be moved in an opposite direction, and the turn-over driving segment drives the convex post 315 to move from the turn-over segment to the movement segment and slide into the opening slot to realize the turn-over. An action of moving means that when the drill bit 301 is facing the borehole wall, the motor assembly 302 and the drill bit 301 both move toward or away from the borehole wall. When the action of moving is performed, the sliding plate 309 slides, and the movement driving segment can drive the motor assembly 302 and the convex post 315 located in the opening slot to move together in the movement segment and the core-breaking segment, either the convex post 315 and the slider 314 move together from the movement segment to the core-breaking segment, or the convex post 315 and the slider 314 move together from the core-breaking segment to the movement segment. An action of core-breaking means that the motor assembly 302 is slightly swung about the mounting shaft 316 connecting the same with the slider 314 (for example, a preset angle may be 3 to 5 degrees, etc.). When performing the action of core-breaking, the slider 314 is located in the core-breaking segment, the convex post 315 is located in the opening slot, the sliding plate 309 slides slightly, the core-breaking driving segment drives the convex post 315 to squeeze an inner wall of the opening slot in the core-breaking segment to perform core-breaking, and the motor assembly 302 swings to realize the core-breaking action.

In addition, as shown in FIG. 13 and FIG. 14, the core-breaking reset assembly 311 is mounted at a side of the core-breaking segment for resetting the convex post 315 and the slider 314 after breaking the core, so as to ensure operation stability of the coring device and ensure that the coring device can be continuously used for coring. As shown in FIG. 14, the fixing plate 308 has a guide rail slot 313 and a guide rail is correspondingly arranged at an edge of the sliding plate 309, and the guide rail is movably mounted in the guide rail slot 313 and can be moved leftward and rightward within the guide rail slot 313.

The above-described core-pushing drilling assembly includes a drilling rod 304 and a core-pushing rod 305 arranged in parallel. Both of the drilling rod 304 and the core-pushing rod 305 are arranged parallel to the axis of the base body 100 and are slidable along the axial direction of the base body 100. One end of the drilling rod 304 is connected with the output end of the hydraulic module 400, and the other end of the drilling rod 304 is connected with the second transverse beam 310, so that the sliding plate 309 can be driven to slide along the axial direction of the base body 100 to transmit power for actions of turn-over, moving and core-breaking. One end of the core-pushing rod 305 is also connected with the output end of the hydraulic module 400, and the other end of the core-pushing rod 305 corresponds to an inlet of the core storage barrel 307.

Figure 2:
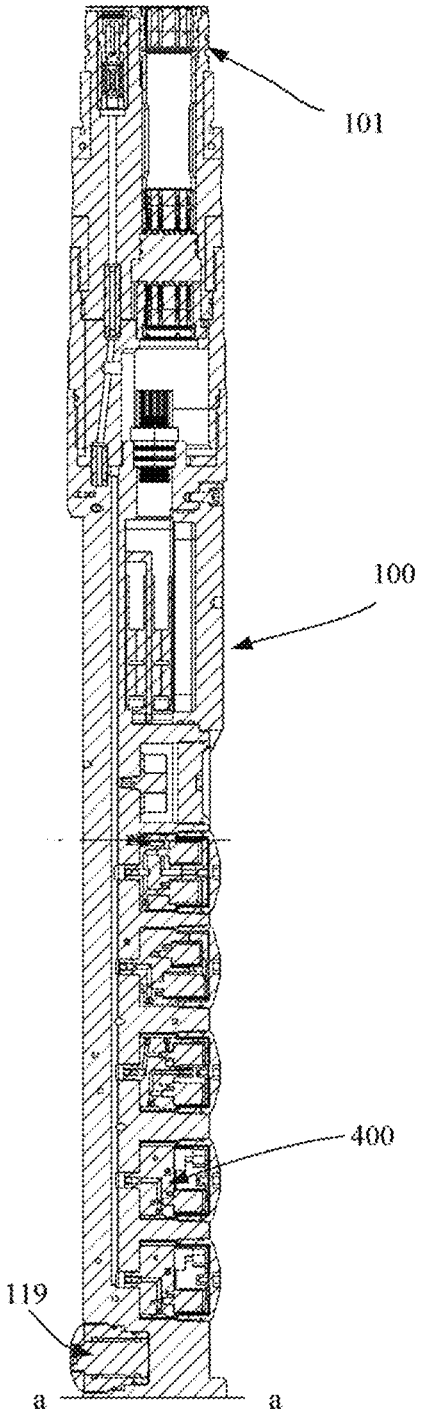
FIG. 2 is a schematic diagram of an upper segment of the coring and sampling integrated sub in FIG. 1 in a retracted state.
Figure 3:
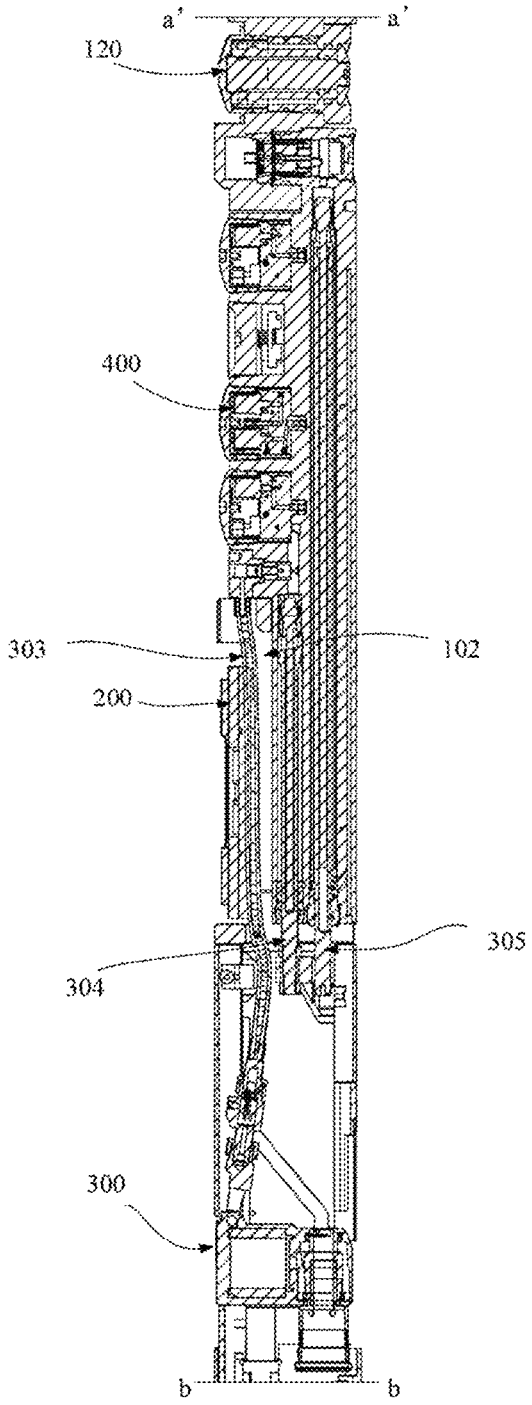
FIG. 3 is a schematic diagram of a middle segment of the coring and sampling integrated sub in FIG. 1 in the retracted state.
Figure 4:
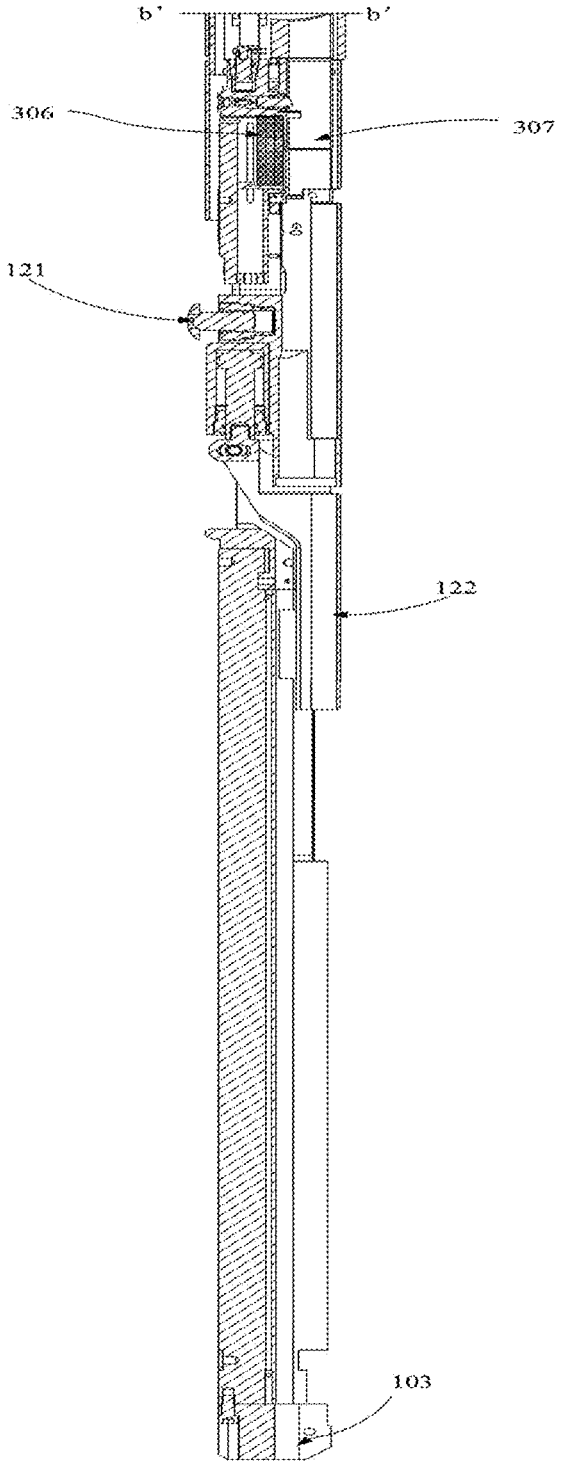
FIG. 4 is a schematic diagram of a lower segment of the coring and sampling integrated sub in FIG. 1 in the retracted state.
Figure 5:
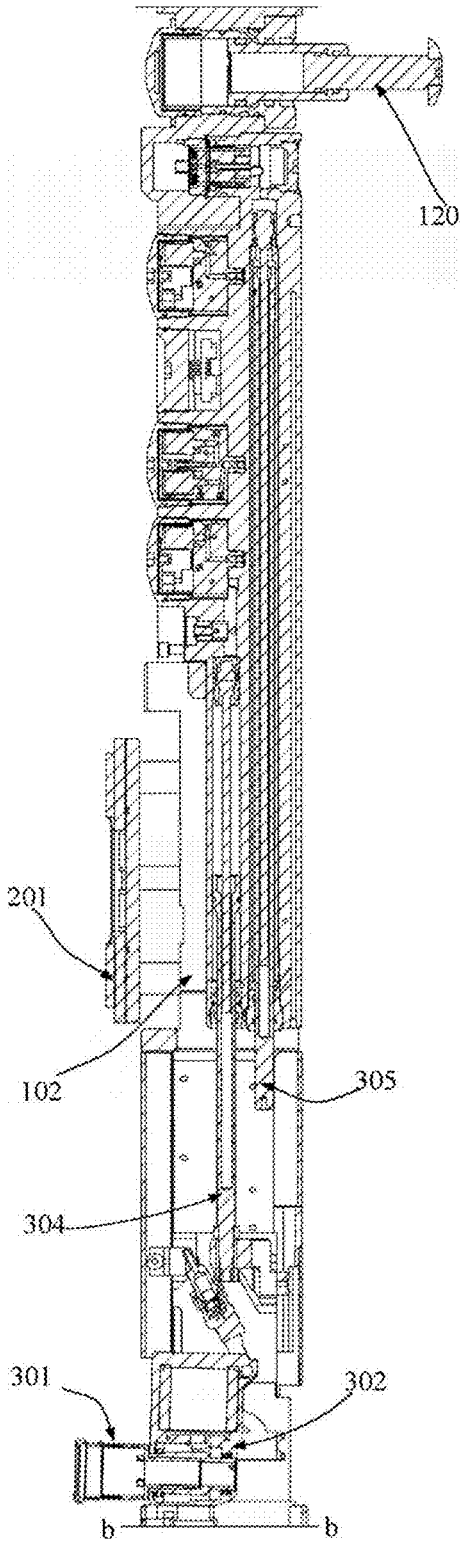
FIG. 5 is a schematic diagram of a middle segment of the coring and sampling integrated sub of FIG. 1 in an unfolded state.
Figure 6:
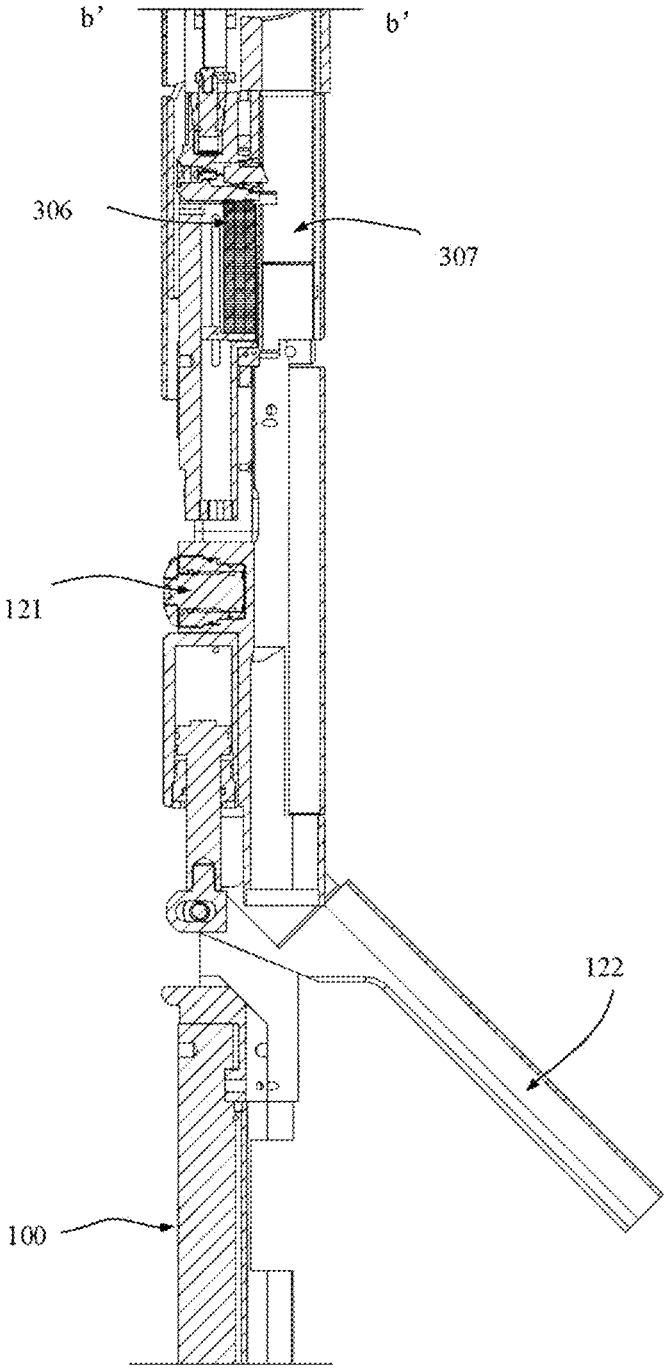
FIG. 6 is a schematic diagram of a lower segment of the coring and sampling integrated sub of FIG. 1 in an unfolded state.

As also shown in FIG. 1 and FIG. 7, the coring device and the probe are located at the same position in the circumferential direction of the base body 100, i.e. when the drill bit 301 and the probe 201 extend out of the base body 100, the probe 201 is directly above the drill bit 301, so that a sampling position on the borehole wall is directly above a coring position on the borehole wall, but is not limited thereto. For example, positions of the drill bit 301 and the probe 201 extending out of the base body 100 may be faced away from each other. With the above integrated layout, the spacing between the coring device and the probe 301 in a length direction of the base body 100 is less than 600 mm, and it can be controlled as 488 mm in this example, thus shortening an occupied length as much as possible. As shown in FIG. 2 to FIG. 6, the base body 100 is provided with an upper push arm 120 and a secondary push arm 122. The upper push arm 120 is located at an upper side of the probe module 200 and located on the hydraulic control segment 107 on a side facing away from the probe 201. The secondary push arm 122 is disposed at a lower side of the coring device, and located on the coring segment 109 also on a side facing away from the probe 301. Input ends of the upper push arm 120 and the secondary push arm 122 are respectively communicated with the hydraulic module 400 through the oil passage, and the upper push arm 120 and the secondary push arm 122 are respectively extended and unfolded by hydraulic pressure, so as to press the base body against the borehole wall. In addition, the base body 100 is further provided with two release push arms. The number of release push arms is not limited to two, which can also be one or more than two. The two release push arms are respectively a first release push arm 119 and a second release push arm 121. The first release push arm 119 is located at the upper side of the probe 201, and the second release push arm 121 is located at the lower side of the coring device. The first release push arm 119 and the second release push arm 121 are located at a side of the base body 100 where the probe 201 is disposed, and the first release push arm 119 and the second release push arm 121 are both connected with the hydraulic module 400 and can be extended and retracted under the control of the hydraulic module 400. Thus, as shown in FIG. 2 to FIG. 4, the sub is in the retracted state, that is, the probe 201, the drill bit 301, the upper push arm 120, and the secondary push arm 122 and the like located thereon are all retracted into the base body 100, while as shown in FIG. 5 and FIG. 6, the unfolded state of the sub means that the probe 201, the drill bit 301, the upper push arm 120, and the secondary push arm 122 and the like are all extended out of the base body 100. The extension and retraction of the probe 201, drill bit 301, upper push arm 120 and secondary push arm 122 and the like are all driven and controlled by hydraulic module 400.

Figure 16:
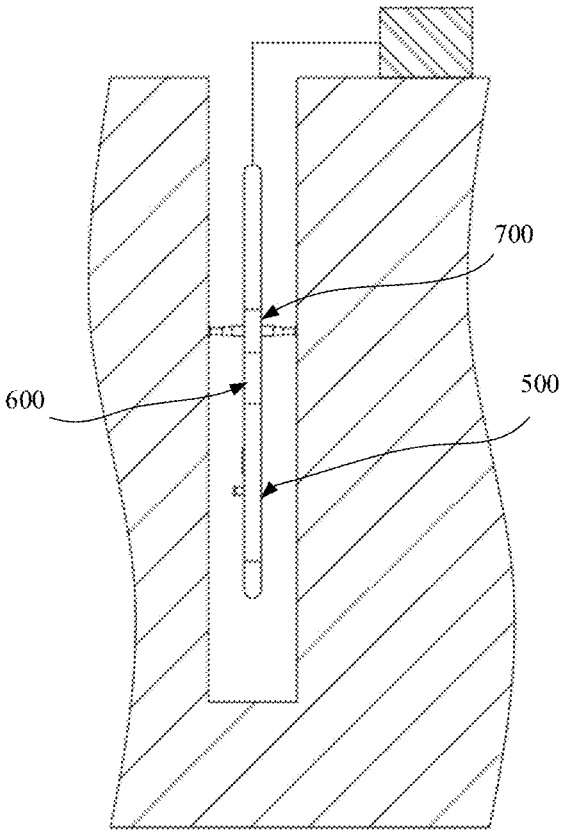
FIG. 16 is a schematic diagram of a downhole instrument according to an embodiment of the present disclosure.

In an exemplary embodiment, as shown in FIG. 16, a downhole instrument includes the coring and sampling integrated sub 500 described above, and further includes a support sub 700, a telescopic sub 600, etc. The downhole instrument may be connected by a long cable to a ground system that is on the ground, while the downhole instrument needs to be lowered into a wellbore. The ground system can demodulate, process, store and display data information uploaded by the downhole instrument, and send out a control instruction and modulate the sent command, so that the ground system can control attitudes and actions of the downhole instrument. In addition, the ground system can also supply power to multiple motors of the downhole instrument. The support sub 700, the telescopic sub 600 and the coring and sampling integrated sub 500 are sequentially connected from top to bottom, and an upper end of the support sub 700 and a lower end of the coring and sampling integrated sub 500 can also be connected with other subs. The support sub 700 has four support arms in different directions, which can abut against the borehole wall and fix the downhole instrument in axial and circumferential directions. The telescopic sub 600 can be extended and retracted along the axial direction to achieve the purpose of changing the length of the sub, and the telescopic sub 600 can be extended or retracted independently by at least 500 mm. Both the support sub 700 and the telescopic sub 600 are provided with cables, oil passages, and fluid channels penetrating therethrough, which do not interfere with power supply, hydraulic control, and sampling.

Thus, the support arms of the support sub 700 are retracted, the upper push arm 120 and the secondary push arm 122 are extended, and in cooperation with the probe 201 being extended, so that a formation fluid can be drawn after the probe 201 is in place, and a sampling operation can be completed. Subsequently, the probe 201 is retracted, the upper push arm 120 and the secondary push arm 122 are also retracted, while the support arms of the support sub 700 are unfolded to ensure that a position of the downhole instrument in a vertical direction remains unchanged. Then, the telescopic sub 600 is contracted, a contraction distance of the telescopic sub 600 is consistent with a distance between the probe 201 and the coring device, and the coring and sampling integrated sub 500 is moved up, so that the coring device comes to the sampling position. Finally, the support arms of the supporting sub 700 are retracted, the upper push arm 120 and the secondary push arm 122 are extended, the downhole instrument abuts against the borehole wall, and the drill bit 301 is extended to complete core-drilling, core-breaking and core-pushing until the core enters the core storage barrel, thus completing the whole coring operation. Alternatively, the coring instrument can perform coring first and then sampling, that is, after coring is routinely completed, the support sub 700 acts to stabilize the downhole instrument vertically, the telescopic sub 600 is extended, and the coring and sampling integrated sub 500 is moved down, so that the probe 201 is lowered to the coring position, and then a sampling process is carried out. Therefore, the coring and sampling points of the downhole instrument are at a same depth and orientation, that is, the coring and sampling are realized at a same position, and formation objects obtained in this process can be evidences of each other, and a logging accuracy is higher.

Figure 17:
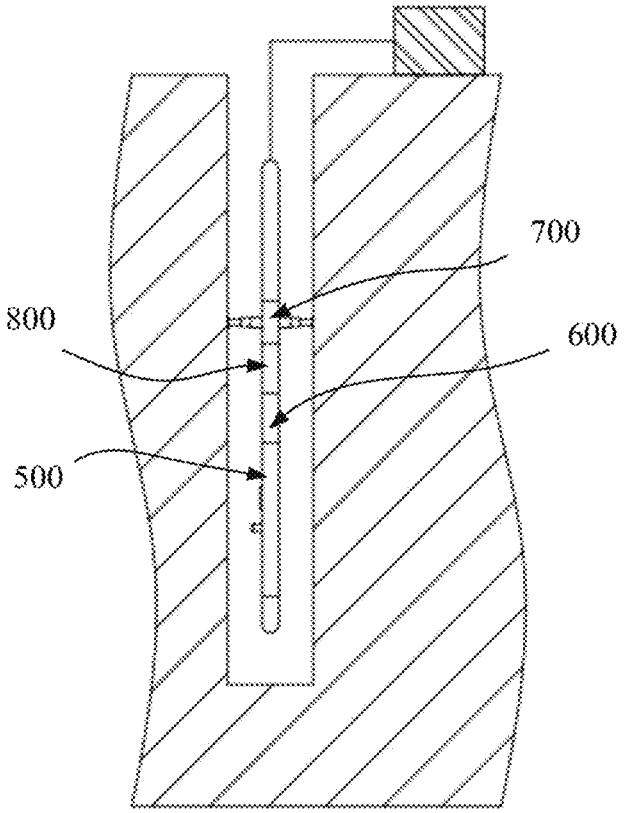
FIG. 17 is a schematic diagram of a downhole instrument according to another embodiment of the present disclosure.

In another exemplary embodiment, as shown in FIG. 17, the downhole instrument further includes a rotation sub 800. The rotation sub 800 is located between the support sub 700 and the telescopic sub 600, The rotation sub 800 can be controlled to rotate in the circumferential direction, and its rotation angle can be controlled, so that the coring and sampling integrated sub 500 can also rotate in the circumferential direction, so that not only the coring and sampling at the same position can be realized, but also the coring or sampling at multiple positions in the circumferential direction at the same depth can be realized, thus providing richer data reference for a later stage.

In another exemplary embodiment, the downhole instrument includes the rotation sub 800 but no longer includes the telescopic sub 600, the rotation sub 800 is located between the support sub 700 and the coring and sampling integrated sub 500, thus enabling coring or sampling at multiple positions in the circumferential direction at the same depth.

Combined with the embodiments described above, in the coring and sampling integrated sub according to the embodiments of the present invention, the coring module and the probe module for sampling are integrated on one sub, which can cover thicknesses of most of the reservoirs, greatly shorten the length of the downhole instrument, reduce the cost and improve the safety. The length of the sub according to the embodiments of the present invention is relatively small, so that coring and sampling at a same layer are possible, and the coring device and the probe are disposed in a same position in the circumferential direction of the base body, and the instrument can be extended and retracted in the length direction, so as to complete the coring and sampling at the same position and obtain core and fluid sample of the same layer. Multiple hydraulic control valves are integrated in the hydraulic module according to the embodiments of the present invention, and the coring, sampling and other operations share the power of the hydraulic module. The integrated design reduces manufacturing costs, further reduces size and weight of the instrument, and improves operation safety.

In the description of the embodiments of the present invention, it should be noted that the orientation or position relationships indicated by the terms "upper", "lower", "one side", "the other side", "one end", "the other end", "side", "relative", "four corners", "periphery" and "square structure" and the like are based on the orientation or position relationships shown in the drawings, which are only for convenience of describing the embodiments of the present invention and simplifying the description, rather than indicating or implying that the structure referred has the specific orientation, is constructed and operated in the specific orientation, and thus cannot be interpreted as a limitation on the present invention.

In the description of the embodiments of the present invention, unless otherwise explicitly specified and limited, the terms "connection", "direct connection", "indirect connection", "fixed connection", "mounting" and "assembly" should be understood in a broad sense, for example, they may be fixed connection, detachable connection or integrated connection; and the terms "mounting", "connection" and "fixed connection" may be direct connection, or indirect connection through an intermediary, or may be an internal communication between two elements. For those of ordinary skills in the art, specific meanings of the above terms in the present invention can be understood according to specific situations.

Although implementations disclosed in the present invention are described above, the described contents are only implementations used for facilitating understanding of the present invention, and are not intended to limit the present invention. Without departing from the spirit and scope disclosed in the present invention, any person skilled in the art to which the present invention pertains may make any modification and change to the form and details of implementation, but the scope of patent protection of the present invention shall still be defined by the appended claims.

The invention claimed is:

1. A coring and sampling integrated sub, comprising an integrally formed base body, a probe module, a coring module and a hydraulic module, wherein the probe module, the coring module and the hydraulic module are all mounted on the base body;

the hydraulic module, the probe module and the coring module are disposed in sequence from top to bottom;

an output end of the hydraulic module is respectively connected with the probe module and the coring module, and the hydraulic module provides a telescopic power for the probe module, and provides power for movement, turn-over and core-pushing of the coring module;

wherein the base body comprises a probe segment disposed between the hydraulic module and the coring module, the probe module is mounted on the probe segment; a core-pushing drilling assembly is provided at the output end of the hydraulic module, the core-pushing drilling assembly penetrates through the probe segment and is connected with the coring module; and the coring module is provided with a cable extending upwards and penetrating through the probe segment.

2. The coring and sampling integrated sub according to claim 1, wherein the probe segment is provided with a mounting groove, the mounting groove penetrates through the probe segment vertically, and the core-pushing drilling assembly and the cable penetrate through the mounting groove; and the probe module comprises a probe and a drive structure, the drive structure is mounted on the probe segment, and an output end of the drive structure is connected with the probe; the drive structure comprises two hydraulic drive assemblies, and the two hydraulic drive assemblies are correspondingly disposed at two sides of the mounting groove respectively.

3. The coring and sampling integrated sub according to claim 2, wherein each of the hydraulic drive assemblies comprises a plurality of outward-extension hydraulic cylinders and at least one retraction hydraulic cylinder, wherein the outward-extension hydraulic cylinders and the retraction hydraulic cylinder are respectively in fluid communication with the hydraulic module, and the hydraulic module controls actions of the outward-extension hydraulic cylinders and the retraction hydraulic cylinder; the outward-extension hydraulic cylinders are configured to push the probe outwards so that the probe abuts against a borehole wall, and the plurality of outward-extension hydraulic cylinders are uniformly arranged along a length direction of the probe; the retraction hydraulic cylinder is intermediately provided on the probe, and the retraction hydraulic cylinder is configured to pull the probe back to the base body.

4. The coring and sampling integrated sub according to claim 3, wherein both the outward-extension hydraulic cylinders and the retraction hydraulic cylinder are provided as single-action hydraulic cylinders.

5. The coring and sampling integrated sub according to claim 3, wherein the coring module comprises a coring device and a core storage barrel disposed at a lower side of the coring device;

the core-pushing drilling assembly comprises a drilling rod and a core-pushing rod, wherein the drilling rod and the core-pushing rod are arranged in parallel, one end of the drilling rod is connected with the output end of the hydraulic module, the other end of the drilling rod is connected with the coring device, and the drilling rod is configured to turn over and move the coring device; one end of the core-pushing rod is connected with the output end of the hydraulic module, and the other end of the core-pushing rod is configured to push an obtained core downward to an inlet of the core storage barrel.

6. The coring and sampling integrated sub according to claim 4, wherein the coring module comprises a coring device and a core storage barrel disposed at a lower side of the coring device;

the core-pushing drilling assembly comprises a drilling rod and a core-pushing rod, wherein the drilling rod and the core-pushing rod are arranged in parallel, one end of the drilling rod is connected with the output end of the hydraulic module, the other end of the drilling rod is connected with the coring device, and the drilling rod is configured to turn over and move the coring device; one end of the core-pushing rod is connected with the output end of the hydraulic module, and the other end of the core-pushing rod is configured to push an obtained core downward to an inlet of the core storage barrel.

7. The coring and sampling integrated sub according to claim 4, wherein each of the outward-extension hydraulic cylinders comprises a first hydraulic chamber and a first piston, the first hydraulic chamber is disposed on the base body, one end of the first piston extends into the first hydraulic chamber, the other end of the first piston is threaded with the probe, and the plurality of first hydraulic chambers of either of the hydraulic drive assemblies are in fluid communication through a first channel to ensure synchronous action.

8. The coring and sampling integrated sub according to claim 7, wherein the base body is provided with a special-shaped end cap, the special-shaped end cap is configured to be detachably connected with the base body, the special-shaped end cap is disposed at a side of the base body facing away from the probe; the first channel comprises a connection channel and a branch channel, the connection channel is disposed on the special-shaped end cap, and the branch channel is disposed on the base body and provides fluid communication between the connection channel and the first hydraulic chamber.

9. The coring and sampling integrated sub according to claim 8, wherein the coring module comprises a coring device and a core storage barrel disposed at a lower side of the coring device;

the core-pushing drilling assembly comprises a drilling rod and a core-pushing rod, wherein the drilling rod and the core-pushing rod are arranged in parallel, one end of the drilling rod is connected with the output end of the hydraulic module, the other end of the drilling rod is connected with the coring device, and the drilling rod is configured to turn over and move the coring device; one end of the core-pushing rod is connected with the output end of the hydraulic module, and the other end of the core-pushing rod is configured to push an obtained core downward to an inlet of the core storage barrel.

10. The coring and sampling integrated sub according to claim 7, wherein the probe is in fluid communication with a sampling channel within the base body through a telescopic suction channel, the sampling channel extends upwards; the hydraulic module is in fluid communication with the first hydraulic chamber through an oil passage.

11. The coring and sampling integrated sub according to claim 10, wherein the coring module comprises a coring device and a core storage barrel disposed at a lower side of the coring device;

the core-pushing drilling assembly comprises a drilling rod and a core-pushing rod, wherein the drilling rod and the core-pushing rod are arranged in parallel, one end of the drilling rod is connected with the output end of the hydraulic module, the other end of the drilling rod is connected with the coring device, and the drilling rod is configured to turn over and move the coring device; one end of the core-pushing rod is connected with the output end of the hydraulic module, and the other end of the core-pushing rod is configured to push an obtained core downward to an inlet of the core storage barrel.

12. The coring and sampling integrated sub according to claim 7, wherein the coring module comprises a coring device and a core storage barrel disposed at a lower side of the coring device;

the core-pushing drilling assembly comprises a drilling rod and a core-pushing rod, wherein the drilling rod and the core-pushing rod are arranged in parallel, one end of the drilling rod is connected with the output end of the hydraulic module, the other end of the drilling rod is connected with the coring device, and the drilling rod is configured to turn over and move the coring device; one end of the core-pushing rod is connected with the output end of the hydraulic module, and the other end of the core-pushing rod is configured to push an obtained core downward to an inlet of the core storage barrel.

13. The coring and sampling integrated sub according to claim 2, wherein the base body is provided with an upper push arm and a secondary push arm, the upper push arm is disposed at an upper side of the probe module, the secondary push arm is disposed at a lower side of the coring module, and input ends of the upper push arm and the secondary push arm are respectively in fluid communication with the hydraulic module through an oil passage; the base body is provided with at least one release push arm, and the release push arm is disposed at a side where the probe is located.

14. The coring and sampling integrated sub according to claim 13, wherein the coring module comprises a coring device and a core storage barrel disposed at a lower side of the coring device;

the core-pushing drilling assembly comprises a drilling rod and a core-pushing rod, wherein the drilling rod and the core-pushing rod are arranged in parallel, one end of the drilling rod is connected with the output end of the hydraulic module, the other end of the drilling rod is connected with the coring device, and the drilling rod is configured to turn over and move the coring device; one end of the core-pushing rod is connected with the output end of the hydraulic module, and the other end of the core-pushing rod is configured to push an obtained core downward to an inlet of the core storage barrel.

15. The coring and sampling integrated sub according to claim 2, wherein the coring module comprises a coring device and a core storage barrel disposed at a lower side of the coring device;

the core-pushing drilling assembly comprises a drilling rod and a core-pushing rod, wherein the drilling rod and the core-pushing rod are arranged in parallel, one end of the drilling rod is connected with the output end of the hydraulic module, the other end of the drilling rod is connected with the coring device, and the drilling rod is configured to turn over and move the coring device; one end of the core-pushing rod is connected with the output end of the hydraulic module, and the other end of the core-pushing rod is configured to push an obtained core downward to an inlet of the core storage barrel.

16. The coring and sampling integrated sub according to claim 1, wherein the coring module comprises a coring device and a core storage barrel disposed at a lower side of the coring device;

the core-pushing drilling assembly comprises a drilling rod and a core-pushing rod, wherein the drilling rod and the core-pushing rod are arranged in parallel, one end of the drilling rod is connected with the output end of the hydraulic module, the other end of the drilling rod is connected with the coring device, and the drilling rod is configured to turn over and move the coring device; one end of the core-pushing rod is connected with the output end of the hydraulic module, and the other end of the core-pushing rod is configured to push an obtained core downward to an inlet of the core storage barrel.

17. The coring and sampling integrated sub according to claim 16, wherein the coring device and the probe are disposed at a same position in a circumferential direction of the base body.

18. The coring and sampling integrated sub according to claim 16, wherein a spacing between the coring device and the probe in a length direction of the base body is less than 600 mm.

19. A downhole instrument comprising the coring and sampling integrated sub according to claim 1.

* * * * *